US005378497A

United States Patent [19]

Johnson et al.

[11] Patent Number: 5,378,497

[45] Date of Patent: Jan. 3, 1995

[54] METHOD FOR PROVIDING IRREVERSIBLE SMOOTHNESS IN A PAPER RAWSTOCK

[75] Inventors: Dean R. Johnson, Columbia; Hans W. Maurer, Highland, both of Md.

[73] Assignee: Westvaco Corporation, New York, N.Y.

[21] Appl. No.: 16,077

[22] Filed: Feb. 10, 1993

[51] Int. Cl.[6] ..... B05D 1/00; B05D 5/00

[52] U.S. Cl. ..... 427/211; 427/361; 427/363; 427/364; 427/365; 427/366; 427/428; 162/206; 162/207

[58] Field of Search ..... 427/211, 361, 363, 364, 427/365, 366, 428; 162/206, 207

[56] References Cited

U.S. PATENT DOCUMENTS

| | | | |
|---|---|---|---|
| 4,596,633 | 6/1986 | Attwood | 162/206 |
| 4,749,445 | 6/1988 | Ureeland | 427/366 |
| 4,973,441 | 11/1990 | Keller | 264/280 |
| 5,076,888 | 12/1991 | Korpela | 162/206 |

OTHER PUBLICATIONS

The effect of moisture and moisture gradients on the calendering of paper, M. B. Lyne, pp. 641–669.

Effect of pretreatment of LWC basestock on coated paper properties, Tappi Journal, P. Lepoutre, W. Bichard, and J. Skowronski, Dec. 1986, pp. 66–70.

Precalendering and its effect on paper-coating interaction, Tappi Journal, G. Engstrom and J. F. LaFaye, Aug. 1992, pp. 117–122.

*Primary Examiner*—Shrive Beck
*Assistant Examiner*—Brian K. Talbot

[57] ABSTRACT

The method comprises the application of a liquid film to a paper or paperboard rawstock web in a controlled and uniform manner to achieve a moisture gradient in the Z-direction thickness of the web to a depth of less than about one-half of the web thickness, and then pressing the treated web in at least one nip of a calender device before drying the web. The liquid application plasticizes only the surface fibers of the web so that the paper fibers at or near the surface become deformed and bonded under pressure to achieve a substantially irreversible smoothness upon being rewetted in a coating application or the like.

14 Claims, 2 Drawing Sheets

METHOD FOR PROVIDING IRREVERSIBLE SMOOTHNESS IN A PAPER RAWSTOCK

BACKGROUND OF INVENTION

It is known that an otherwise untreated web of paper or paperboard rawstock will react adversely to the application of a liquid by becoming rougher, since the surface fibers of the web absorb moisture leading to fiber swelling, breaking of hydrogen bonds and fiber reorientation. If the liquid application is in the form of a coating or the like, the web may actually become smoother, because of the presence of smoothing ingredients in the coating, but the improvement in smoothness is not as great as would be expected because the surface of the rawstock beneath the coating becomes roughened in the presence of the liquid phase of the coating. Because of this phenomenon, and because one of the objectives in the production of paper and paperboard is to produce a smooth finish, it is desirable to smooth the surface of the rawstock web before coating.

One of the known techniques for at least partially smoothing the surface of a web of paper or paperboard rawstock is to finish the web. This may be accomplished by calendering the web using a machine calender on a papermachine. The degree of finish obtained by this method depends upon the nip pressure reached in the calender. However, the smoothness obtained by machine calendering is short lived when the web is subsequently brought into contact with water or a composition containing water, since dry cellulose fibers will not bond under pressure. On wetting, there will be substantial recovery due to fiber swelling and release of stress. An improvement in this technique is to calender the web while it is wet. The compressing of plasticized cellulose fibers will consolidate the web without undue stress, and the surface achieved will retain a substantial amount of its integrity for a longer time after wetting than is common for a web that is compressed in an essentially dry state. Conventional processes for wet calendering employ either a water box on the calender, water sprays, or steam showers. Unfortunately the use of these methods is haphazard at best and difficult to control, so that the results are not predictable. In most cases, the quantity of moisture transferred to the web is uneven, too great or too small, resulting in unsatisfactory results. Nevertheless, recent innovations in the paper industry have provided equipment that is capable of applying controlled amounts of water to a web in a uniform manner, and it was the introduction of this equipment that made the present invention possible.

DESCRIPTION OF PRIOR ART

The importance of having a smooth rawstock surface on the printability of coated paper is well known. Pigmented coatings tend to hide or cover up some of the surface imperfections in a paper rawstock. However, the effectiveness of a coating in smoothing the surface of a paper web depends upon the condition of the surface on which the coating is applied.

In machine coating, it is common practice to pass the paper web between two heavy rolls, known as a smoothing press, when part of the press section, as a breaker stack, when used in mid papermachine position, or as a machine calender, just prior to applying coating. Paperboard to be coated on the papermachine may also be smoothed in a calender stack, with or without a water box, or it may be treated with water or a dilute starch solution in a size press prior to coating. Paperboard for off machine coating may be treated with water or starch size on the calenders, or it may be sized in a size press to lay the fuzz and smooth the sheet.

Recent innovations in metered film technology have made it possible to apply uniformly controlled amounts of liquids to a web surface to achieve an optimum smoothness. Equipment such as the Voith Speedsizer and other equipment is available for this purpose and may be used in the method of the present invention. Moreover, the concept of moisture gradient finishing, as specified in the present invention, is also known. An investigation by M. B. Lyne of the Swedish Forest Products Research Laboratory reported in the article "The Effect of Moisture and Moisture Gradients on the Calendering of Paper", describes the optimization of surface plasticity of a cellulosic web by creating Z-direction gradients in moisture content and temperature at the moment of calendering to achieve a smooth surface without gross structural collapse. However, the investigation did not correlate the effect of moisture gradient calendering with a subsequent coating operation. In a related disclosure, U.S. Pat. No. 4,973,441 describes a calendering process by which the surface of a dried web is smoothed for subsequent printing, writing or coating. In the process, a plasticizer is applied to a rough paper surface to penetrate fibers near the paper surface which can be easily compressed to impart smoothness, while the interior of the web remains dry and relatively incompressible. However this disclosure does not correlate any effect on a subsequent coating process, and in particular the effect of the time lapse between the application of the plasticizer and the calendering step. Similarly, in U.S. Pat. No. 4,596,633, a process is taught which involves the rewetting of a thin layer (5–10% of the thickness) of a web and then pressing the moistened surface against a substantial portion of the surface of a heated dryer drum to produce a smooth surface without the usual compaction which occurs during calendering. However, as in the case of the aforementioned prior art, there is no correlation with improvements related to a subsequent coating application. More to the point, there is published at least two investigations directed to studies of the pretreatment of a paper rawstock and the effect on paper coating. In the article "Effect of pretreatment of LWC basestock on coated paper properties", by P. Lepoutre, W. Bichard and J. Skowronski, the authors studied the effects of calendering with and without the addition of a polymer as a pretreatment, and concluded that calendering was effective as a pretreatment particularly in combination with a polymer application. Meanwhile, in the article "Precalendering and its effect on paper-coating interaction", by G. Engstrom and J. F. Lafaye, the study compared paper taken from the papermachine (uncalendered) and samples of the same paper which was supercalendered (pre-calendered). The authors concluded that fiber flocs expand when the base paper comes into contact with the water in the coating color and that expansion of fiber flocs was greater in the precalendered base paper. The increase in surface roughness for sheets made from mechanical pulp was so high that the whole effect of the pre-calendering was lost. Thus it may be seen that there is a recognized relationship between the pretreatment of paper webs prior to coating and the effects on the coated product.

SUMMARY OF INVENTION

When a web of paper rawstock is exposed to water during a coating process, its surface beneath the coating layer becomes roughened. In order to offset as much as possible of this increase in roughness, the present invention is directed to a process whereby the paper rawstock is wet-calendered before coating. More particularly, the present invention is directed to a process whereby a thin film of liquid is uniformly applied only to the surface of the rawstock web to create a moisture gradient within the Z-direction thickness of the web, before pressing the web after a controlled time delay in a subsequent pressure nip. The application of a thin film of liquid to the paper surface allows only the surface fibers of the web to be plasticized, so that, upon pressing, the surface of the web is fixed, and a subsequent coating application will have a minimal impact on the surface of the web. According to the present invention, the paper surface may be characterized as being substantially irreversibly smoothened by practicing the process described herein. One of the keys of the present invention resides in the time lapse between the application of the liquid film to the web and the pressing step. In the preferred method of the invention, the web is pressed prior to the time that the liquid application has a chance to completely penetrate the full thickness of the web. Most desirably, the liquid is permitted to penetrate the web in the Z-direction to no more than about one-half of its thickness, and in doing so, produces a moisture gradient in the Z-direction of the web on the order of from about 3–50%, e.g., about 3–20% moisture at the center of the web thickness to about 30–50% moisture at the surface of the web. If too little time elapses between the application of liquid and the pressing step, the result is not substantially different from that achieved by dry finishing. If too much time elapses, the liquid will penetrate through substantially the entire thickness of the web and the web may become blackened and overly densified during the pressing step. The liquid used to plasticize the paper surface can be plain water, heated or at ambient temperature, or a solution or dispersion of a binder, thickener, or functional additive. Water soluble materials such as starch, modified starch, polyvinyl alcohol, carboxymethylcellulose, hydroxyethylcellolose, alginates, natural or synthetic gums, polyacrylates, fluorescent whitening agents, polyacrylamides, polyethylene imines, or other related materials may be used. Water dispersable materials, for example, various latex or resin compositions such as styrene butadiene, polyvinylacetate, polyacrylics, grafted starch or gums, and other copolymers or terpolymers may be used. The liquid may contain dispersions of sizing agents, such as alkylketene dimer, styrene-maleic-anhydride copolymer, water soluble soaps, and pigments, such as kaolin clay, structured kaolin clay, bonded pigment clusters, talc, calcium carbonate, titanium dioxide and similar materials which can impart a pore filling and/or brightening and opacifying effect to the paper surface. Finally, electrolytes may be dissolved in the water, preferably salts or organic agents which prevent corrosion of metal surfaces which are wetted during the subsequent pressing step.

The present invention may be practiced on any grade of paper which contains moisture sensitive fibers. These include bleached, unbleached, recycled paper and paperboard. The paper web may consist solely of cellulose fibers, a mixture of cellulose and synthetic fibers, or paper filled with mineral or organic pigments. The paper can be unsized or sized in the furnish and/or on the surface, provided the water sensitivity of the fibers is retained.

The pressing step may take the form of a typical calendering operation including one or more pairs of nipped rolls loaded to produce a nip pressure on the order of 400–7000 psi. The nipped rolls may be fabricated from steel, or a steel roll and a soft cover roll may be used to provide a soft nip. In a preferred embodiment of the invention, the pressing step comprises a nip with one roll heated to a surface temperature of up to about 300° F. One nip with controlled loading force will normally suffice, but multiple nips, in tandem or stacked may also be employed. In another preferred embodiment, the liquid applied is heated to effect the plasticization of the surface fibers and the critical time frame for interaction between the paper and liquid to obtain the desired Z-direction moisture gradient. In a further embodiment of the invention, the web is pressed in the dry state in a calender nip for partial compression, then wetted and wet calendered as described above.

Therefore, with the foregoing in mind, it is a primary object of the present invention to provide an improvement in the wet calendering of paper and paperboard rawstock webs which is not affected by the drawbacks or limitations of the prior art.

Another and more specific object of the present invention is the provision of a method of wet calendering that generates a high level of surface smoothness that is essentially resistant to reversion after re-wetting of the surface by a water based coating composition. The desired goal is to obtain an essentially irreversibly smooth surface by a combination of the following steps:

1. Applying a film of liquid to the surface of a paper or paperboard rawstock uniformly and in a controlled manner, of a thickness commensurate with the thickness and roughness of the paper or paperboard to be treated.

2. Allowing the applied liquid film sufficient time to plasticize the surface fibers but to limit the combined effects of penetration and vapor diffusion into the web to a depth of no more than about one-half the thickness of the web, to plasticize only the surface fibers of the web.

3. Pressing the treated web in a compression nip with sufficient pressure to achieve surface leveling of the web, smoothness development and fiber bonding.

4. Drying the web in a manner so that the surface smoothness achieved will be retained during a subsequent coating process.

DETAILED DESCRIPTION

Figure 1:
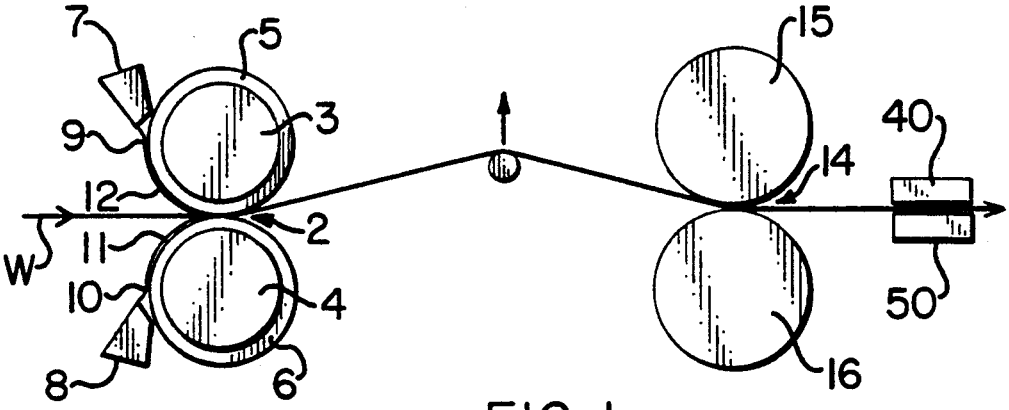
FIG. 1 is a side elevational view showing schematically one method for practicing the present invention.

FIG. 1 illustrates a typical calender apparatus for treating both sides of a paper or paperboard rawstock web W simultaneously. The liquid application nip 2 comprises a pair of rolls 3, 4 with soft covers 5, 6 to form a soft nip. The rolls 3, 4 are adjustable by means of any suitable conventional roll adjustment device for threading the web W through the nip 2 and may include loading devices if desired for varying the pressure in the nip. Liquid application devices 7, 8 are located adjacent to each roll 3, 4 and include liquid film metering elements 9 and 10 for controlled application of a uniform film of liquid to each side of the web. The liquid application devices 7, 8 may comprise devices well known to those skilled in the art including Voith's Speedsizer or Duo coater, Valmet's Sym Sizer, the Jagenberg Film Press, or the like. The fluid metering elements may include a wire wound rod, a profiled rod, a serrated rod, a bar or a blade, bent or unbent. Such devices are well known in the art. The fluid metering elements 9, 10 apply thin films of liquid 11, 12 to the soft covers 5, 6 of the rolls 3, 4 which are transferred to the web W in nip 2. The application of the thin films of liquid is followed by a pressing step in nip 14 between steel calender rolls 15, 16. The success of the present invention is achieved by providing only enough time between the liquid application at nip 2 until the pressing step takes place in nip 14, to allow the liquid films 11, 12 to penetrate the web W to a depth of no more than about one-half of the thickness of the web, to achieve a suitable moisture gradient, and so as to plasticize only the surface fibers of the web before the web is compressed. After the wetted rawstock is pressed in nip 14, the web W is dried at 40, 50 by suitable driers to a moisture content suitable for a subsequent coating application.

Figure 2:
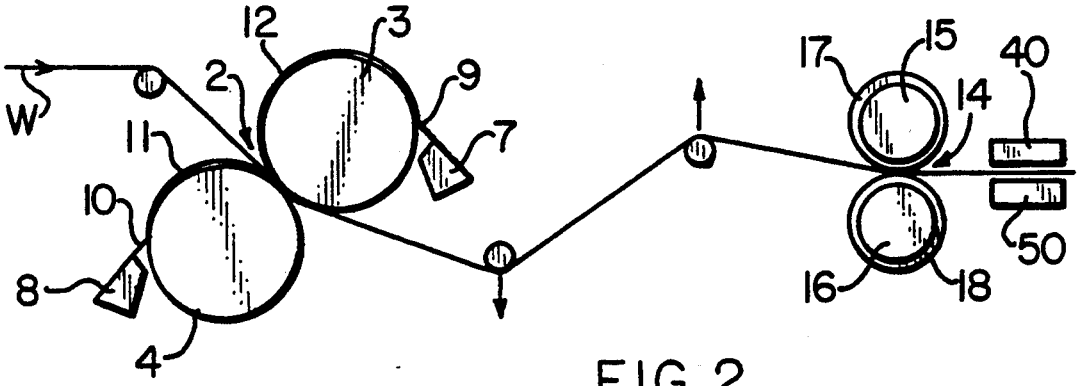
FIG. 2 is a side elevational view showing an alternative method for practicing the invention; and, FIG. 3 is a side elevational view showing yet another method for practicing the invention.

FIG. 2 illustrates another method for applying liquid to the surface of the web W and then pressing the web In this case, the liquid application step uses two rolls 3, 4 which form an application nip 2. Liquid film applicators 7 and 8 are arranged adjacent the rolls 3, 4 with metering elements 9, 10 for simultaneously treating both sides of the web. The treated web is subsequently pressed in a nip 14 between rolls 15, 16 which, for this embodiment, have soft covers 17, 18, and dried by drying devices 40, 50. It should be understood in this connection that for the embodiments of FIGS. 1 and 2, the nips 2 and 14 may be formed by one soft roll and one hard roll, or two hard rolls, if desired.

Figure 3:
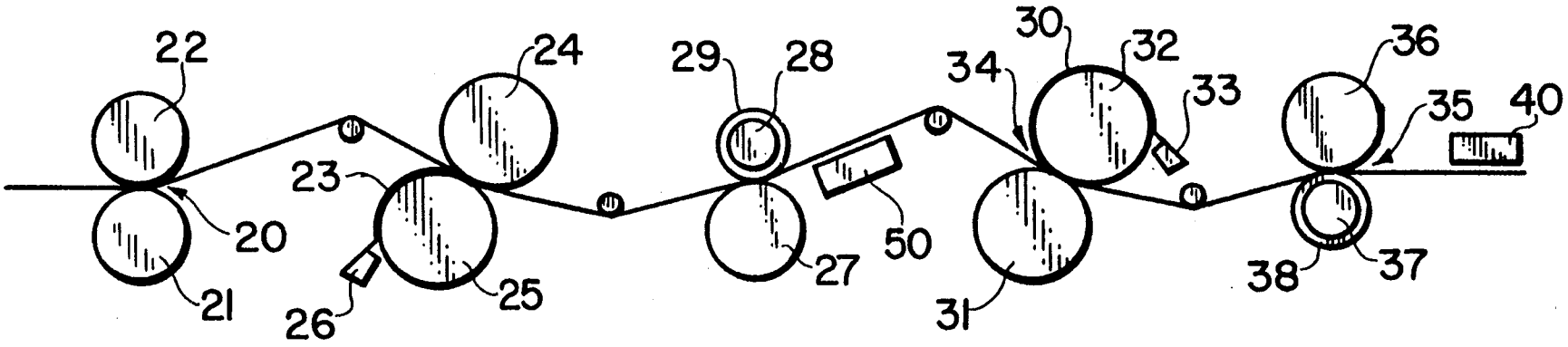

In FIG. 3, the web W is treated in two steps, with a liquid film applied first to one side and then to the other side of the web. Also, FIG. 3 shows an initial treatment of the web before practicing the present invention at a pre-compression nip 20. As shown in FIG. 3, the web W is initially pre-compressed between two rolls 21, 22 at nip 20. Next, the lower surface (wire side) of the web is applied with a film of liquid 23 between rolls 24, 25 by a liquid applicator 26. The web is then pressed in a soft nip formed by rolls 27, 28 where the roll against the untreated side of the web has a soft cover 29, and dried by drier device 50. Next the upper surface (felt side) of the web W is treated with a liquid film 30 from a liquid applicator 33 at a nip 34 formed between two rolls 31, 32. After that, the web is pressed in nip 35 formed between rolls 36, 37 wherein the roll 37 has a soft cover 38 in contact with the untreated surface of the web, and dried by drier device 40.

The application of the film of liquid and the time lag between liquid application and pressing is designed to achieve the moisture gradient and surface plasticization mentioned hereinbefore. The depth of penetration of the liquid film into the web is determined by a number of factors including the metered film thickness, the amount of liquid transferred to the web, the loading pressure in the application nip, the void volume of the web at the time of liquid application and the hardness of the rolls. Elapsed time (i.e., reaction time) between liquid application and pressing will affect the capillary flow of moisture into the cellulosic fiber walls, the diffusion of moisture towards the low moisture center of the web from the higher moisture outer surface of the web, evaporation of moisture from the web surface into the surrounding air, and the relaxation and plasticization of the surface fibers. Optimizing the reaction time to minimize diffusion and evaporation plays an important role in the present invention. Under the proper web surface moisture conditions, the smoothness obtained is substantially irreversible upon rewetting In a controlled experiment, the effect of moisture gradient calendering was compared with dry calendering and with an untreated rawstock upon rewetting. The procedure for moisture retention evaluation was as follows. Paper samples comprising an untreated rawstock, a dry calendered rawstock and a moisture gradient calendered rawstock were rewetted with moisture and dried. Sheffield smoothness measurements were made for each of the samples both before and after rewetting. The amount of water applied to the samples during rewetting was equivalent to the amount of liquid in a typical coating composition at 60% solids applied at about 8–10 lbs/ream. Percent smoothness retention was calculated by subtracting the percent increase in roughness from 100%. In an initial experiment, paper rawstock (51 lb basis weight) having a wire side Sheffield roughness of 265 seconds and a caliper of about 4.5 mils was calendered under different loads and speeds using two steel rolls with one roll heated to 185° F. surface temperature and a 4 inch wrap of the treated surface around the heated roll. Moisture gradient conditions included the application of 2 lb/ream water (0.11 mil film) and 4 lb/ream water (0.22 mil film). The results are shown in Table I.

TABLE 1

| WATER APPLIED (lb/rm) | SPEED (fpm) | LOAD (pli) | ROLL TEMP. (°F.) | SHEFFIELD ROUGHNESS BEFORE REWETTING | SHEFFIELD ROUGHNESS AFTER REWETTING | SMOOTHNESS RETAINED % |
|---|---|---|---|---|---|---|
| Rawstock | — | — | — | 265 | 296 | — |
| Dry | 600 | 280 | 185 | 149 | 215 | 56 |
| 2 | 600 | 280 | 185 | 97 | — | — |
| 4 | 600 | 280 | 185 | 99 | 117 | 82 |
| Dry | 600 | 480 | 185 | 102 | 186 | 18 |
| 2 | 600 | 480 | 185 | 74 | 100 | 65 |
| 4 | 600 | 480 | 185 | 76 | 85 | 89 |
| Dry | 600 | 680 | 185 | 82 | 126 | 46 |
| 2 | 600 | 680 | 185 | 58 | — | — |
| 4 | 600 | 680 | 185 | 71 | 76 | 93 |

The interaction time between liquid application and wet calendering for the moisture gradient conditions was 0.70 sec at 600 fpm. Smoothness retention after rewetting averaged about 40% for the dry calendered condition, about 65% for the moisture gradient condition with the application of 2 lb/ream water, and about 88% for the moisture gradient condition where 4 lb/ream of water was applied (ream size 3000 $ft^2$).

In a second experiment, measurements of smoothness retained were recorded only for the moisture gradient calendering conditions. Water was applied at 2 and 4 lb/ream to a 51 #basis weight rawstock and the wetted rawstock was calendered at different conditions of pressure, speed and temperature. The results are shown in Table II.

TABLE 1

| WATER APPLIED (lb/rm) | SPEED (fpm) | LOAD (pli) | ROLL TEMP. (°F.) | SHEFFIELD ROUGHNESS BEFORE REWETTING | SHEFFIELD ROUGHNESS AFTER REWETTING | SMOOTHNESS RETAINED % |
|---|---|---|---|---|---|---|
| 2 | 1000 | 680 | 185 | 90 | 100 | 89 |
| 2 | 800 | 880 | 185 | 80 | 91 | 86 |
| 2 | 1000 | 880 | 185 | 79 | 84 | 94 |
| 4 | 800 | 880 | 185 | 76 | 75 | 100 |
| 4 | 1000 | 880 | 185 | 79 | 80 | 99 |
| 4 | 800 | 880 | 250 | 62 | 62 | 100 |
| 4 | 1000 | 880 | 250 | 71 | 74 | 96 |

The interaction time between liquid application and wet calendering for the conditions set forth in Table II was 0.42 second at 1000 fpm and 0.55 second at 800 fpm. Other tests have shown that the interaction time can be as short as 0.20 second and still achieve measurable results in smoothness retention.

In the preferred practice of the present invention, a liquid film in the range 0.10–0.60 mil thickness is applied to a paper rawstock having an essentially uniform solids content in the range of 80% to 97% to plasticize the surface fibers of the paper. The thickness of the liquid film applied would be dependent on the basis weight of the rawstock used. The liquid is permitted to penetrate the web to achieve a Z-direction moisture gradient of from about 3% to 20% moisture substantially at the center of the web to about 30–50% moisture at the wetted surface. The web is then calendered in a pressure nip formed between at least two nipped rolls of a calender device in from about 0.20–2.0 seconds after moisture application to achieve an irreversibly smooth surface. In a most preferred method, the web has a moisture content less than 20%, on the order of 3%–10%; the liquid film applied has a thickness on the order of about 0.10–0.40 mils; and, the web is calendered within about 0.28–0.72 second after the liquid application.

It will thus be seen that the present invention provides an effective means for achieving a substantially irreversible smoothness in a paper rawstock intended for coating.

What is claimed is:

1. The method of achieving a smooth finish on at least one surface of a web of paper rawstock which is substantially resistant to loss of smoothness in any subsequent papermaking process involving the application of water, comprising:

(a) providing a web of paper rawstock having two surfaces and a uniform moisture content of up to about 20% throughout its thickness;

(b) applying a uniform film of a moisturizing liquid of controlled thickness to at least one surface of the web of step (a) in a pressure nip to plasticize the surface fibers of the web and to achieve a moisture gradient of moisturizing liquid within the web to a depth of at least but not more than about one-half of the web thickness;

(c) pressing the moistened web within about 0.2–2.0 seconds after step (b) in a pressure nip formed between at least two nipped rolls of a calender device; and, (d) drying the paper rawstock.

2. The process of claim 1 wherein the moisturizing liquid applied to the surface of the web has a film thickness on the order of from about 0.10 to 0.60 mil.

3. The process of claim 2 wherein the moisture gradient within the thickness of the web achieved between steps (b) and (c) is from up to about 20% moisture substantially at the center of the web to about 30–50% moisture at the moistened surface of the web.

4. The process of claim 1 wherein the moisturizing liquid has a film thickness on the order of from about 0.10 to 0.20 mil.

5. The process of claim 4 wherein the moisture gradient within the thickness of the web achieved between steps b) and (c) is from about 3–20% moisture substantially at the center of the web to about 30–50% moisture at the moistened surface of the web.

6. The process of claim 1 wherein the film of moisturizing liquid has a minimum thickness of about 0.10 mil.

7. The process of claim 1 wherein one of the rolls of the pressure nip of step (c) in contact with the treated surface of the web of step (b) is heated to a surface temperature of up to about 300° F.

8. The process of claim 1 wherein the moisturizing liquid is applied to both surfaces of the web simultaneously in the pressure nip of step (c).

9. The process of claim 1 wherein the web of step (a) is pretreated at a pre-compression nip prior to the application of the moisturizing liquid of step (b).

10. The process of claim 1 wherein the pressure in the nip of step (c) is from about 400–7000 psi.

11. The method of achieving a smooth finish on the surfaces of a web of paper rawstock which is substantially resistant to loss of smoothness in any subsequent process involving the application of a liquid, comprising:

(a) providing a web of paper rawstock having a substantially uniform solids content in the range of from about 80–97% solids throughout its thickness;

(b) applying to the surfaces of the web of step (a) in a pressure nip uniformly thick films of a moisturizing liquid to plasticize the surface fibers of the web and to achieve a moisture gradient of moisturizing liquid from each surface within the thickness of the web, to a depth of at least but not more than one-half the web thickness, of from about 3–20% moisture at the center of the web to about 30–50% moisture at each moistened surface of the web;

(c) pressing the moistened web in a pressure nip formed between at least two nipped rolls of a calender device within 0.28–0.70 second after step (b); and, (d) drying the paper web.

12. The method of claim 11 wherein the moisturizing liquid of step (b) is selected from the group consisting of water, heated water, a solution of water and a binder, and a dispersion of water and a binder.

13. The method of claim 12 wherein the solution of water and a binder is selected from the group consisting of starch, modified starch, polyvinyl alcohol, carboxymethylcellulose, hydroxyethylcellulose, alginates, natural gums, synthetic gums, polyacrylates, fluorescent whitening agents, polyacrylamide and polyethylene imines.

14. The method of claim 12 wherein the dispersion of water and a binder is selected from the group consisting of styrene butadiene, polyvinylacetate, polyacrylics, grafted starch, grafted gums and sizing agents.

* * * * *